US005211383A

United States Patent [19]

Valentinis

[11] Patent Number: 5,211,383

[45] Date of Patent: May 18, 1993

[54] DEVICE FOR ARRANGING DOCUMENTS PRINTED ON CONTINUOUS STRIPS

[75] Inventor: Francesco Valentinis, Milan, Italy

[73] Assignee: CEM S.p.A., Italy

[21] Appl. No.: 841,711

[22] Filed: Feb. 26, 1992

[30] Foreign Application Priority Data

Mar. 12, 1991 [IT] Italy ..... MI91 A 000652

[51] Int. Cl.[5] ..... B65H 41/00

[52] U.S. Cl. ..... 270/52.5; 270/58

[58] Field of Search ..... 270/21.1, 46, 52, 52.5, 270/58, 59

[56] References Cited

U.S. PATENT DOCUMENTS

| | | | |
|---|---|---|---|
| 2,677,317 | 5/1954 | Vogt | 270/58 |
| 4,014,535 | 3/1977 | Kleid et al. | 270/21.1 |
| 4,273,319 | 6/1981 | Stocker | 270/21.1 |
| 4,381,107 | 4/1983 | Armiger | 270/58 |
| 4,684,118 | 8/1987 | Boss et al. | 270/58 |
| 5,020,434 | 6/1991 | Copham | 270/52.5 |

FOREIGN PATENT DOCUMENTS

| | | |
|---|---|---|
| 0427068 | 5/1991 | European Pat. Off. . |
| 8203845 | 11/1982 | PCT Int'l Appl. . |
| 651526 | 9/1985 | Switzerland . |

*Primary Examiner*—Edward K. Look
*Assistant Examiner*—Gregory Bulla
*Attorney, Agent, or Firm*—Steinberg & Raskin

[57] ABSTRACT

A device for arranging documents printed on continuous strips, of the type using at least two continuous strips each printed in at least two columns. The device comprises conveyor belts for advancing the strips, rotating blades for longitudinally cutting the strips, at least one additional blade for transversely cutting at least a part of the strips, a movable wall for directing the documents, obtained from the strips, to at least one waiting and selective sorting station for the documents and to a transit section, and a collecting station for the documents originating from the waiting station and transit section and comprising a conveyor belt for selectively sorting the documents to obtain the required arrangement.

10 Claims, 2 Drawing Sheets

DEVICE FOR ARRANGING DOCUMENTS PRINTED ON CONTINUOUS STRIPS

This invention relates to a device for arranging documents printed on continuous strips.

Devices of the aforesaid type are already known. These, starting from documents printed on two separate continuous strips, assemble books or booklets comprising a certain number of main documents (for example cheques, invoices, bank statements, luncheon vouchers) printed on a first strip, and some accessory documents (for example covers or enclosures of various types) printed on the second strip and inserted in determined positions of the book or booklet.

Both the main documents and the accessory documents are printed on the two side-by-side strips in several columns.

Each book can contain a variable number of both main and accessory documents.

Each document is generally personalized with written details or different numbers for each document. These personal data are printed on the various documents by a slalom method in which the data relative to a first document of a first column are printed, after which the printing passes to the document to the side of the first in the next column and so on, and when there are no more documents left in that row the printing passes to the next row.

It can happen that because of the variable number of documents in a book, the same row can contain differently personalized documents relative to two or more books (for example, in the case of continuous strips printed with two columns, the last cheque of a first cheque book and the first of a second cheque book).

In the known art the continuous strip carrying the main documents in several columns is fed to a first device; the strip carrying the accessory documents in several columns is fed to a second device of the same type as the first and positioned to the side of it. The two devices are controlled by a microprocessor control unit which controls the various stages in the treatment of the two strips. Substantially, by means of methods using system members and sensors obvious to the expert of the art, the two continuous paper strips are advanced through a certain distance in order to be able to make the necessary transverse and longitudinal cuts in the continuous strip and obtain from it the documents ready for assembly. Having been cut, these are each fed into a relative waiting seat which can be put into communication with an underlying conveyor belt by means of an inclined wall. For each book to be arranged, the control unit contains in its memory the relative binding sequence and the position in which the various documents forming the book are printed on the continuous strip. Using algorithms known to the expert of the art, this unit can then feed one document at a time towards the inclined walls and underlying belt in a precise order. The documents then pass from the strip to a collector in such a manner as to superpose the various documents in the required order. The packs of documents obtained in this manner are then fed to usual joining devices, i.e. stapling and/or binding and/or folding, and wrapping.

When all the document seats of one of the two advancement and cutting devices are free, the advancement and cutting cycle begins again.

The aforedescribed known device suffers from serious defects.

Firstly it is apparent that as two separate devices are required for handling the two continuous paper strips, the system is of large overall dimensions and hence not particularly functional, and is very unwieldy.

Once the documents have been cut they have to travel considerable distances before reaching the collector, resulting either in a lengthy production time or the need to work at high speed, with the inevitable consequences of wear and faults.

The device also suffers from serious mechanical restraint problems on changing the format of the documents.

In this respect, if working with documents of a different format than normal, the element comprising the waiting seats and the inclined walls has to be completely replaced as these parts are dimensioned individually for the particular type of document.

All this obviously involves considerable cost related both to the production of particular mechanical elements for each type of document and to the long periods required for replacing these elements, during which the machine remains inoperative.

Other methods are known in which the two continuous strips, comprising main and accessory documents, are fed to a single device. In this case, in contrast to the preceding, the documents are printed on the strips continuously in a single column. This device operates as follows.

A microprocessor control unit causes the first or second strip to advance towards a single unit for transversely and longitudinally cutting the documents, and then to a collector, depending upon whether a main or an accessory document is to be placed in this latter. The main problem of machines of this type is related to the use of continuous strips printed in a single column.

In this respect, this fact results in an inevitable slowing down of production, both during the "personalization" printing and during the ordinary printing.

An object of the present invention is to provide a device for arranging documents printed on continuous strips of the type able to handle two continuous strips carrying personalized documents printed in several columns by the slalom method.

A particular object of the invention is to provide a small-dimension compact device able to process both the continuous strips by a single cutting unit.

A further object is to provide a device in which the documents, once cut, need to travel only short distances to reach the collector, so that precise and reliable operation is ensured as the device is able to operate at not too high a speed.

A further object is to provide an extremely versatile device able to operate with different sized documents without parts of the device having to be removed or replaced, hence leaving the device inoperative for only a very short change-over time.

These and further objects which will be apparent to the expert of the art are attained by a device for arranging documents printed on continuous strips in at least two columns, characterized by comprising means for advancing the continuous strips, means for longitudinally cutting said strips, at least one means for transversely cutting at least a part of said strips, waiting stations for the documents once cut, conveyor means for the documents originating from the waiting stations, and control means advantageously of microprocessor type.

The present invention will be more apparent from the accompanying drawing, which is provided by way of non-limiting example, and in which.

Figure 1:
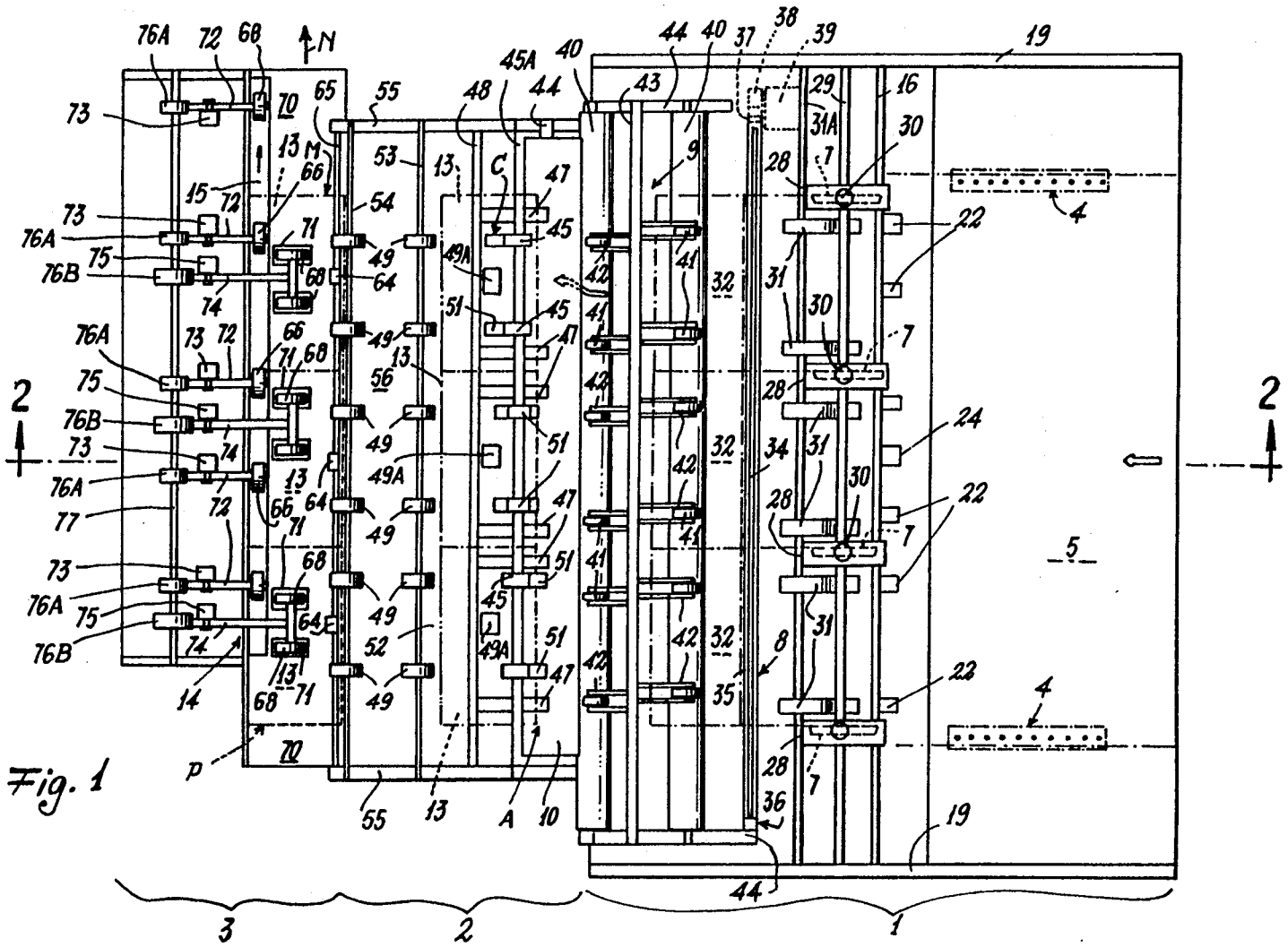
FIG. 1 is a schematic plan view of the device according to the invention.

With reference to said figures, the device according to the invention comprises substantially three parts 1, 2, 3 connected in series.

The first part 1 comprises schematically a series of toothed conveyor belts 4 for advancing two continuous strips 5, 6 (FIG. 2) perforated along their longitudinal edges and zonally printed in several columns; it also comprises a number of rotating blades 7, 7' for longitudinally cutting the strip, further non-rotating blades 8 for at least partly transversely cutting them (as will be illustrated hereinafter), and means 9 advancing documents 13 (FIG. 1) obtained from the strips by these cutting operations and defined by dashed and dotted lines in the figure.

The second part 2 receives the documents 13 cut within the first part of the device and comprises a wall 10 rotatable into two positions, for example by the action of an actuator, not shown, to direct said documents to a first waiting station 11 or to an underlying transit section 12 according to whether said documents have been obtained from the first strip 5 or from the second strip 6.

The third part 3 receives the documents 13 both from the first waiting station 11 and from the transit section 12, and comprises a series of rotating members 14 for conveying the documents 13 onto a transverse conveyor belt 15 which feeds them to a usual collector (not shown).

More Specifically, and with reference to the first part 1 of the device, this comprises four (FIG. 2) usual toothed conveyor belts 4 which cooperate with the perforated tracks along the sides of the two continuous strips 5 and 6, to advance them.

The four belts 4 rotate (FIG. 2) about drive gears 18 (connected by belts to two separate motors 19 and 20) and about driven gears 21 all mounted on the walls 19 of the first part of the device, in known manner.

Figure 2:
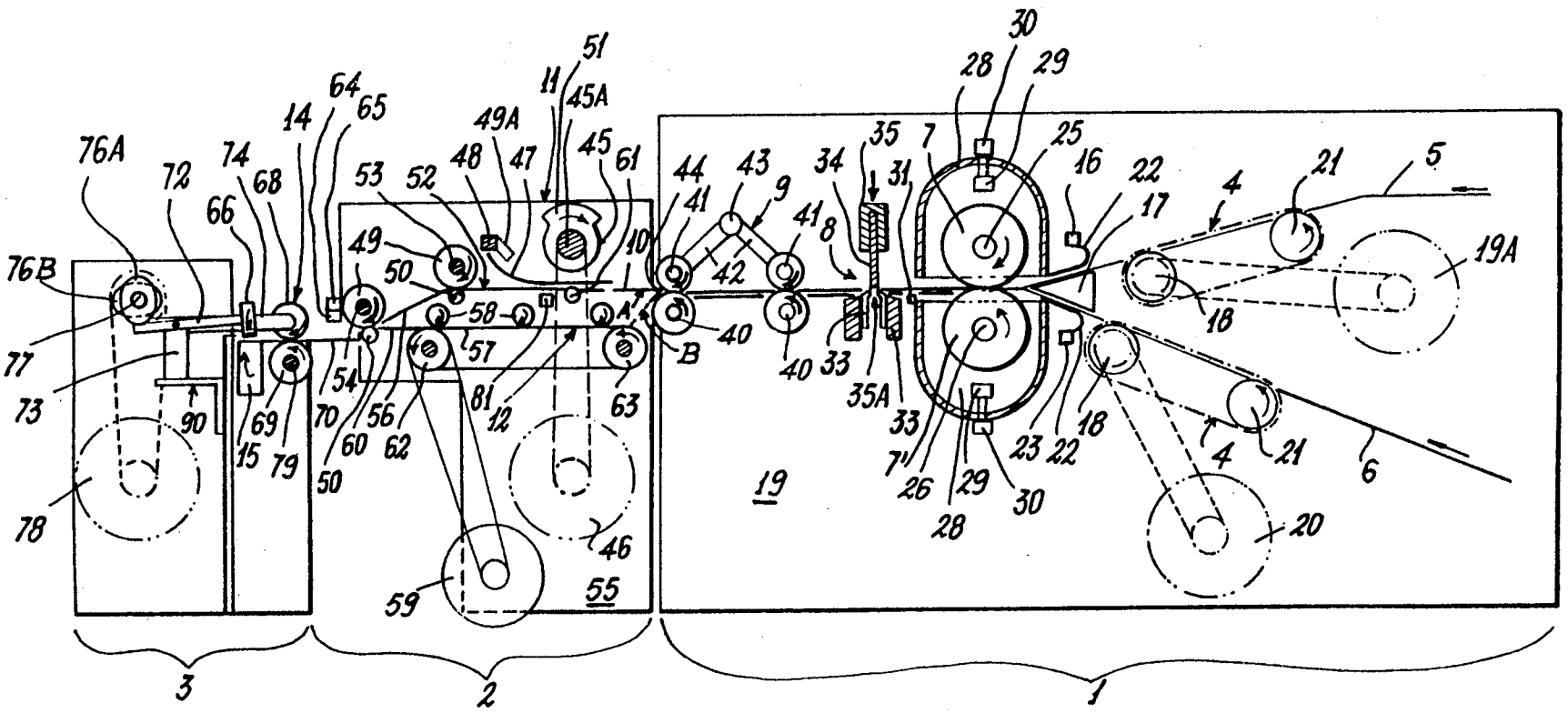
FIG. 2 is a schematic sectional view therethrough on the line 2—2 of FIG. 1.

The conveyor belts 4 are arranged in pairs, one for each strip, and are superposed to form between them an angle of about 60° such that the two strips 5, 6 are made to advance along two superposed planes converging towards the longitudinal rotating blades 7 (FIG. 2). The two continuous strips 5, 6 are guided towards the blades 7 by the walls of a wedge-shaped element 17 and shoes 22 connected to an upper cross-member 16 and a lower cross-member 23, which are fixed to the lateral walls 19.

On each of the two cross-members 16, 23 there is also mounted a usual proximity sensor 24 (FIG. 1) to sense the presence of the continuous strip. In this example, on two spaced-apart vertical parallel shafts 25 and 26 there are mounted respectively four mutually opposing circular blades 7, 7' rotating in opposite directions (the upper blades relative to the lower blades), so as to be able to longitudinally cut the continuous strip, which as stated is advanced between the blades. For the cutting operation each blade 7 cooperates with an underlying blade 7'.

The shafts 25, 26 are coupled in known manner to a motor (not shown). In addition the blades 7, 7' are protected by a substantially bell-shaped element 28 which covers them to leave only a small part free for cutting the strips, so that accidental contact cannot be made with the blades. The bell-shaped elements 28 are mounted on a cross-member 29 fixed to the walls 19 of the device, and along which they can be moved and positioned. The bell-shaped elements 28 also comprise a screw 30 for their locking in the preferred position. On moving the bell-shaped elements 28 the blades 7, 7' are also moved, to hence adjust the position of the longitudinal cuts along the strips 5, 6.

In this respect, the blades are torsionally rigid with respective shafts 25, 26, but can be moved along them together with the respective bell-shaped element with which they are axially rigid in known conventional manner.

A pair of guides 31 (FIG. 1) is provided between each blade to guide the strips 32 (FIG. 1) cut by the blades 7 towards the blades 8 for the transverse cut. These guides are supported by cross-members 31A such that they can be set in the desired position on these cross-members.

For the transverse cut two fixed blades 33 are provided (see FIG. 2) having slightly greater longitudinal dimensions than the transverse dimensions of the continuous strips 5, 6 and having their cutting edges in opposing positions spaced apart by a short distance to form a slit 35A. Into the slit 35A defined by the two blades 33 there is inserted a third reciprocatingly movable blade 34 which cooperates with the two blades 33 to make the desired cut. The movable blade 34 is mounted on a frame 35 having one end 36 (FIG. 1) hinged to a wall 44 of the device such that said blade can rotate in a vertical plane perpendicular to that of FIG. 1. The other end of the frame is connected to a connecting rod 37 (shown dashed in FIG. 1) associated eccentrically with a plate 38 (shown dashed in FIG. 1) coupled to a usual direct current electric motor 39 advantageously of stepping type, with a coaxial encoder (shown dashed in FIG. 1) which enables the stroke of the blade 34 to be varied. As the blade 34 is hinged at one end, transverse cuts of a greater of lesser length can be made according to the eccentric stroke. For example it is possible to cut not through the entire strip 5, 6 but only through a part, which can differ as required, while maintaining integral the uncut part destined for subsequent operating stages.

In other words, the movable blade is hence moved with rocking motion within the slit 35A between the two blades 33, and by controlling the motor for example by the microprocessor control unit (not shown), the blade 34 can be made to penetrate completely or only partly into the slit 35A so that the continuous strip is transversely cut either completely or only partly, i.e. to the required degree.

The documents obtained in this manner are advanced towards the movable wall 10 by roller systems indicated by 9 (in FIG. 2) which comprise two drive rollers 40 positioned one after the other in one and the same plane, and eight idle dragging rollers 41, four of which oppose and are in contact with the first drive roller and the remainder with the second.

The drive rollers have a length slightly greater than the transverse dimension of the continuous strips 5 and 6 and are associated in known manner with a usual electric motor (not shown).

The dragging rollers 41 are carried by arms 42 (FIGS. 1 and 2) secured to a cross-member 34 fixed to walls 44 of the device.

The movable wall 10 of the part 2 of the device which receives the documents dragged by the rollers 40 is hinged at 44 (FIG. 1) and can move into two positions (indicated by the arrows A and B in FIG. 2) so that the documents 13 can be directed towards the upper transit section 11 (FIG. 2) or the lower transit section 12 (FIG. 2). Hence the wall in question acts as a sorter.

The wall is connected in known manner to a usual lever system and to an electric motor (not shown), for example a relay for movement into the two positions A and B on the basis of the control effected by the microprocessor.

The transit section 11 comprises, above a horizontal surface 52 (FIG. 2) along which the documents 13 travel, six sector wheels 45 mounted on a shaft 45A associated via a belt (shown dashed in FIG. 2) with a usual direct current electric stepping motor with a coaxial encoder, a series of guide shoes 47 and proximity sensors 49A fixed to a cross-member 48, and twelve drive rollers 49 and idle counter-rollers 50.

The wheels 45 present a sector 51 projecting from a first disc of smaller radius, the sector extending through about one third of the circumference of the first disc, i.e. through an angle of about 120°.

The wheels 45 are arranged in pairs along the shaft 45A; each pair has its respective sectors 51 arranged in mutual phase, and each pair has its sectors 51 offset by about 120° from the preceding pair. In this manner the wheels 45, by cooperating with the idle counter-rollers 61 (FIG. 2), initially drag only that document in contact with the sectors 51 of a first pair, then that underlying the adjacent pair, and then that of the last pair.

The documents are guided in their movement along the surface 52 by the shoes 47 and are then dragged by the rollers 49, 50 along an inclined wall 56 towards the third part 3 of the device.

The drive rollers 49 are distributed six on a first shaft 53 and the other six on a second shaft 54, the two shafts being associated in known manner with a usual electric motor (not shown). Opposing each of the rollers 49 there is an idle roller 50 rotated by these latter and arranged on cross-members (not shown) fixed to the lateral walls 55 of the part 2 of the device. The rollers 49 and 50 are positioned at the ends of an inclined wall 56 connected at one end to the horizontal wall 52 of the first transit section 11 and at its other end to the third part 3 of the device.

Above the rollers 49 and 50 there are three proximity sensors 64 fixed to a cross-member 65 and arranged to sense the passage of a document between the rollers 49 and 50.

The second transit section 12 (FIG. 2) is located below the first and comprises a conveyor belt 57 and a series of idle rollers 58 driven by this latter for moving the documents deposited thereon when the movable wall 10 is in the position indicated by the arrow B (FIG. 2). The conveyor belt 57 rotates about a drive gear 62 associated with a usual electric motor 59 to which it is connected by a belt, and about a driven gear 63.

Above the belt 57 there are three proximity sensors 81 (FIG. 2) arranged to sense the presence of a document on the belt.

At one end, the belt 57 meets a horizontal surface 60 (FIG. 2) for conveying the documents towards the rollers 49 and 50 which feed them towards the third part 3 of the device.

This latter part comprises a horizontal surface 70 on which the documents 13 arrive dragged by the rollers 49, 50 and a first series of five transverse dragging rollers 66 opposing and cooperating with an underlying transverse conveyor belt 15 in line with the horizontal surface 70 and slightly below the surface 60. There is also provided a second series of six dragging rollers 68 opposing and substantially perpendicular to the rollers 66 and cooperating with driving counter-rollers 69 partly projecting from the surface 70 via apertures 71 (FIG. 1).

The dragging rollers 66 are mounted on rocker arms 72 hinged to members 73 connected to a wall 90 (FIG. 2) of the device, whereas the six rollers 68 are arranged in pairs on rocker cross-arms 74, the longest part of which is hinged to members 75 connectable to the wall 90.

Five cams 76A (FIG. 2) of a camshaft 77 (FIG. 1) cooperate with the free ends of the arms 72, whereas three cams 76B, offset by 90° from the first, cooperate with the arms 74 so that when the shaft 77 rotates it raises the ends of the arms 72 and 74 alternately. By means of a belt (shown dashed in the figure), the shaft 77 is associated with a usual electric motor 78 advantageously of direct current type with a coaxial encoder.

The conveyor belt 15 rotates about a drive gear connected in known manner to a usual direct current electric motor with a coaxial encoder and about a driven gear (not shown in the figures, but of conventional type).

The drive rollers 69 are mounted on a shaft 79 (FIG. 2) associated with a usual electric motor (not shown, but of conventional type).

The device according to the invention is controlled by a control unit advantageously of microprocessor type (not shown), such as a personal computer, which holds in its memory the binding sequence for the documents carried on the continuous strips 5 and 6. Hence the control system contains in its memory the positions in which the various documents are printed on the continuous strips and the order in which these documents have to be directed by the device towards a collector (not shown but conventional) for subsequent treatment. As will be explained hereinafter, this information is used to operate certain elements and/or motors of the device.

A description will now be given by way of example of the operation of the device in which the continuous strip 5 is that carrying the main documents and the strip 6 carriers the secondary documents, for example covers.

Specifically, the case will be considered in which a book has to be arranged composed of five main documents (for example five cheques) and three secondary documents (a top cover, a bottom cover and an accessory document to be inserted between the penultimate and the last of the main documents). In addition, the documents will have been printed on the strips by the slalom method so that the first row of the strip 5 comprises side-by-side from right to left (i.e. in the direction of the arrow M of FIG. 1) the first, the second and the third of the main documents and the second row comprises the fourth followed by the fifth; and the strip 6 comprises side-by-side from right to left the bottom cover, the accessory document and the top cover in one row.

The strips 5 and 6 are firstly made to advance by the toothed conveyor belts 4 until they are in proximity to the blades 7, 7' for the longitudinal cut. The strips are then cut longitudinally and simultaneously by these blades. Specifically, the outer blades 7, 7' cut the perforated track of the strips, while the remaining blades divide the strips into columns of document dimensions. The strips are guided towards the blades by the walls of the wedge-shaped element 17 and by the guide shoes 22.

The control unit then decides which of the two strips should be further advanced (halting one of the devices 18, 21 relative to the other strip) as far as the rollers 40, 41 for the transverse cut, to obtain the documents to be arranged from the columns into which the original strip has been divided.

In the present case, the strip 6 comprising the secondary documents is advanced and, simultaneously, the movable wall 10 is moved into position A so that the documents which have been cut can reach the transit section 11.

By operating the motor 39 the blade 34 is then completely lowered to obtain the three secondary documents (i.e. the front cover, rear cover and accessory document) of the hook to be assembled. When they have been cut, these are dragged by the rollers 40, 41 towards the wall 10 and transit section 11 where, guided by the shoes 47, they halt in proximity to the sector wheels 45. These latter are positioned such that on rotating, the first wheel sector to come into contact with a document is that most to the right (indicated by the arrow C in FIG. 1).

On then operating the motor 46 so that the wheel rotates through only about 120°, the document representing the bottom cover of the book is fed to the rollers 49, 50 while the other documents (accessory document and top cover) in the central and left positions are not moved.

The sensor 49A senses the passage of the document and causes the motor 78 of the camshaft 77 to operate so that this latter lowers the arm 74 and raises the arm 72 of the rollers 68 and 66 respectively. In this manner the document representing the bottom cover is dragged by the rollers 49 and 50 towards the rollers 68, 69 which then feed it onto the conveyor belt 15 and under the rollers 66 where it lies awaiting that document from the strip 5 which according to the arrangement program is to be positioned on it.

At this point the control system causes the strip 5 to advance to the rollers 40 and 41, it then being transversely cut to obtain three of the five main documents.

Simultaneously it also causes the movable wall 10 to move into the position indicated by the arrow B (FIG. 2) so that the documents which have just been cut are all three fed by the rollers 40, 41 towards the transit section 12 and onto the conveyor belt 57. This later feeds the documents towards the rollers 49, 50.

The sensors 81 sense the passage of the documents and cause the arms 72 to rise and the arms 74 to fall.

In this manner, the documents, dragged by the rollers 49, 50, are fed towards the rollers 68, 69 which then drag them onto the conveyor belt 15 and under the rollers 66 to deposit the right document (in accordance with the arrow M of FIG. 1) correctly on top of the bottom cover, which is already waiting. On sensing the passage of the documents, the sensor 64 (as in the preceding case) causes the arms 72 to lower and bring the documents into contact with the belt 15 by the pressure of the wheels 66.

The belt 15 then undergoes a movement such that the left document (indicated by the arrow P in FIG. 1) is transferred into the right position (arrow M of FIG. 1), whereas the others are expelled towards a collector during the same movement.

At this point, the sector wheel 45 is advanced through about 240° so that (as already described) the accessory documents located in the central and left column of the transit section 11 are fed onto the conveyor belt 15.

The documents which have been deposited on the belt 15 are now as follows: to the right the third document of the strip 5; in the centre the accessory document of the strip 6; to the left the top cover.

The control system then causes the strip 5 to again advance as far as the rollers 40, 41. At this point only two of the three documents printed on the strip 5 have to be cut, namely that most to the right and the central one, but not that most to the left, which forms part of another book.

The control system also causes the motor 39 to operate so that the blade 34 inclines through an angle smaller than for the previous cut and penetrates only partly between the two blades 33 to cut only the two desired documents. These latter are then fed towards the belt 15 via the station 12.

After this latter operation the documents will be arranged in the following manner on the belt 15: to the right the third and fourth (penultimate) document of the strip 5 superimposed one on the other; in the centre the accessory document of the strip 6 and the fifth (last) of the strip 5 superimposed one on the other; to the left the top cover of the strip 6.

If the belt 15 is then driven to feed all the documents towards the collector, the book will be arranged in the required sequence, after which the next book can be arranged in exactly the same manner.

What I claim is:

1. A device for arranging documents printed on continuous strips of the type using at least two continuous strips (5, 6) printed in at least two columns, characterised by comprising means (4) for selectively advancing the strips (5, 6), means (7, 7') for longitudinally cutting said strips, at least one means (8) for transversely cutting at least a part of the strips, a means (10) for directing the documents (13), obtained from the strips, to at least one waiting and selective sorting station for the documents and to a transit section (12) for the documents, and conveyor means (14) for the documents originating from the station (11) and from the section (12).

2. An arranging device as claimed in claim 1, characterised in that said longitudinal cutting means comprise a plurality of movable circular blades (7) with movable circular counter-blades (7'), the blades (7) and counter-blades (7') being mounted on a first shaft (25) and on a second shaft (26) respectively.

3. A device as claimed in claim 2, characterised in that said blades (7) and counter-blades (7') are shiftable along the respective shafts (25, 26) and are partly enclosed by a protection element (28) mounted, also shiftable, on a cross-member (29).

4. A device as claimed in claim 1, characterised in that said means (8) for transversely cutting at least a part of the continuous strip (5, 6) comprises two fixed blades (33) having their respective cutting edges mutually opposing to define a slit (35A), and a rotatable blade (34) able to be inserted at least partly into said slit (35A) to effect a transverse cut of predetermined length.

5. A device as claimed in claim 4, characterised in that said rotatable blade (34) is mounted on a frame (35)

hinged at one end (36) and connected at its other end to a crank mechanism driven by a motor (39).

6. A device as claimed in claim 1, characterised in that said means for directing the cut documents (13) is a movable wall (10).

7. A device as claimed in claim 1, characterised in that said waiting and sorting station (11) comprises a plurality of sector wheels (45) for selectively sorting the documents, a plurality of proximity sensors (49A) and a plurality of drive rollers (49) and counter-rollers (50) for dragging the documents.

8. A device as claimed in claim 7, characterised in that said wheels (45) each comprise a sector (51) projecting from a first disc of smaller radius, and are mounted in pairs on a shaft (45A); the sectors (51) of said pairs being in phase with each other but offset by a given angle from the sectors of the adjacent pairs.

9. A device as claimed in claim 1, characterised in that said transit section (12) comprises at least one conveyor belt (57), a plurality of rollers (58) cooperating with the belt, and proximity sensors (81).

10. A device as claimed in claim 1, characterised in that said conveyor means (14) for the documents originating from the station (11) and section (12) comprise a first series of dragging rollers (66) opposing and cooperating with an underlying conveyor belt (15) in line with a horizontal surface (70), and a second series of opposing dragging rollers (68) acting perpendicularly to the rollers of said first series and cooperating with drive counter-rollers (69) projecting partly from the surface (70) via apertures (71), said first series (66) and said second series (68) of rollers being connected respectively to a plurality of controlled rocker arms (72, 74).

* * * * *